US006687474B2

(12) United States Patent
Yamada et al.

(10) Patent No.: US 6,687,474 B2
(45) Date of Patent: Feb. 3, 2004

(54) DEVELOPING APPARATUS, IMAGE FORMATION APPARATUS, AND PROCESS CARTRIDGE

(75) Inventors: Masahiko Yamada, Sakura (JP); Kentaroh Matsumoto, Ichikawa (JP); Hiroyuki Nagashima, Yokohama (JP); Tokuya Ohjimi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/163,990

(22) Filed: Jun. 7, 2002

(65) Prior Publication Data

US 2003/0002884 A1 Jan. 2, 2003

(30) Foreign Application Priority Data

Jun. 8, 2001 (JP) ..... 2001-174776

(51) Int. Cl.[7] ..... G03G 15/08
(52) U.S. Cl. ..... 399/106; 399/259; 399/260
(58) Field of Search ..... 399/106, 262, 399/258, 259, 260, 102, 103, 58, 254, 272, 274; 222/DIG. 1

(56) References Cited

U.S. PATENT DOCUMENTS

| | | | | | |
|---|---|---|---|---|---|
| 4,075,977 | A | * | 2/1978 | Williams | 399/254 |
| 4,456,154 | A | * | 6/1984 | Herriman | 222/DIG. 1 |
| 4,615,608 | A | * | 10/1986 | Mizutani | 399/274 |
| 4,676,192 | A | * | 6/1987 | Yuge et al. | 399/259 |
| 5,107,305 | A | * | 4/1992 | Charland et al. | 399/360 |
| 5,449,095 | A | * | 9/1995 | Kobayashi | 222/DIG. 1 |
| 5,512,708 | A | | 4/1996 | Takahashi et al. | |
| 5,864,733 | A | | 1/1999 | Mae et al. | |
| 6,064,844 | A | * | 5/2000 | Isobe et al. | 399/103 |
| 6,272,298 | B1 | * | 8/2001 | Yamaguchi et al. | 399/106 |
| 6,337,957 | B1 | | 1/2002 | Tamaki et al. | |
| 6,507,718 | B2 | | 1/2003 | Ohjimi et al. | |
| 6,522,855 | B1 | | 2/2003 | Katoh et al. | |
| 6,553,202 | B2 | | 4/2003 | Tamaki et al. | |

FOREIGN PATENT DOCUMENTS

| | | | | |
|---|---|---|---|---|
| JP | 8-20803 | | 2/1989 | |
| JP | 2-44299 | | 11/1990 | |
| JP | 2859905 | | 6/1991 | |
| JP | 06033158 U | * | 4/1994 | G03G/15/08 |
| JP | 2000-284582 | | 10/2000 | |

* cited by examiner

*Primary Examiner*—Susan S.Y. Lee
*Assistant Examiner*—Ryan Gleitz
(74) *Attorney, Agent, or Firm*—Oblon, Spivak, McClelland, Maier & Neustadt, PC

(57) ABSTRACT

A developing apparatus, an image formation apparatus and a process cartridge is provided. Even though the sealing materials of the initial developer container are stripped off in such a way that the process cartridge having the developing apparatus is tilted, the initial developer can be uniformly supplied along the central axis line of the developer carrier. The developing apparatus performs a self toner control and has an initial developer case 10 for containing the non-used initial developer 3*c* that is input into the developer containing space S. The initial developer case 10 is divided internally into a plurality of partition spaces 10*b* along the direction of the central axial line D of the developing sleeve 4, so that a plurality of partitions 10*c* is formed inside the initial developer case 10. Based on the opening 10*a* for inputting the initial developer, the partition surface F facing to the partition space 10*b* of each partition 10*c* is tilted from an imaginary plane G perpendicular to the central axial line D of the developing sleeve 4 toward one end H along the direction of the central axial line D of the developing sleeve 4.

5 Claims, 8 Drawing Sheets

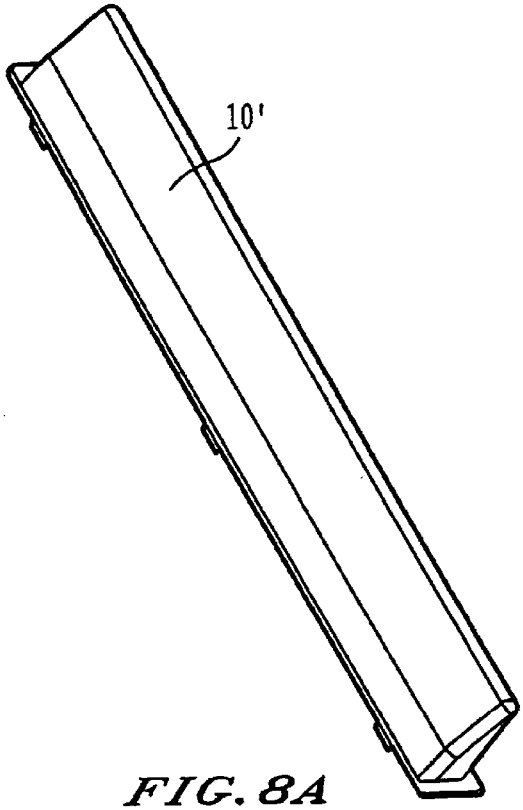
FIG. 8A
(PRIOR ART)
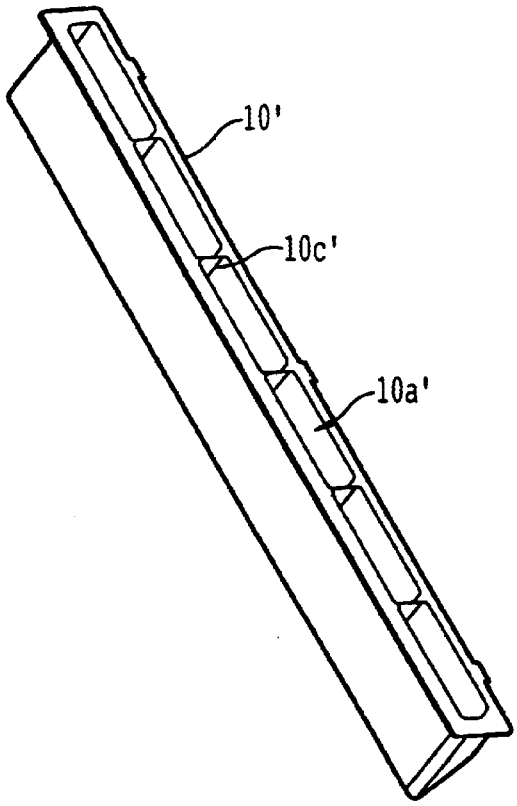
FIG. 8B
(PRIOR ART)
FIG. 9
(PRIOR ART)
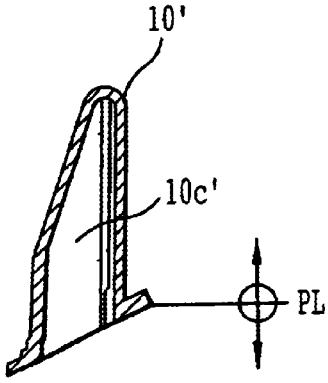

DEVELOPING APPARATUS, IMAGE FORMATION APPARATUS, AND PROCESS CARTRIDGE

CROSS-REFERENCE TO RELATED APPLICATION

This application claims the priority benefit of Japanese application serial no. 2001-174776, filed on Jun. 8, 2001.

BACKGROUND OF THE INVENTION

1. Field of the Invention

This invention relates in general to an image formation apparatus, such as a copy machine, a printer or a FAX machine, and a developing apparatus and a process cartridge that are used in the image formation apparatus. More specifically, the invention relates to a developing apparatus, and an image formation apparatus and a process cartridge having the developing apparatus, wherein the developing apparatus has a self toner concentration controlling machine capable of controlling the toner concentration in the developer on a developer carrier within a preset range, by using a two-component developer containing toner and magnetic carrier, and without using a complicated toner supply device.

2. Description of Related Art

One of the conventional developing apparatuses is disclosed by Japanese Laid Open H09-22179. In the developing apparatus, the amount of the developer is regulated by a developer-regulating unit, wherein the developer is carried on a developer carrier having a magnetic field generating device therein. The developer collected by the developer-regulating unit is contained in a developer container. From the toner supply gate, that is opposite to the developer carrier and is adjacent to the upstream side of the developer transfer direction in the developer container, the toner in the toner container is supplied to the developer on the developer carrier. In the developing apparatus, the toner, in contact with the developer that is carried and transferred on the developer carrier at the toner supply gate, is taken into the developer from an interface between the transferred developer and the developer contained in the developer container. As the toner concentration of the developer in the developer increases, because the volume of the developer increases, the developer contained in the developer container extends so as to cover the toner supply gate, thereby the feeding of the developer from the toner container at the toner supply gate to the developer can be suppressed. In this way, the toner concentration of the developer in the developer carrier can be controlled within a preset range. In addition, Japanese Laid Open H09-197833 discloses a developing apparatus, in which a second developer-regulating unit with a preset gap with respect to the surface of the developer carrier is set between the developer container and the toner supply gate of the toner container. In the developing apparatus, as the toner concentration of the developer in the developer carrier increases, the thickness of the developer increases. The passing of the increased developer is regulated by the second developer-regulating unit. The regulated developer covers the toner supply gate that is adjacent to the upstream side of the developer transfer direction with respect to the second developer-regulating unit, so that the feeding of the toner from the toner container to the developer carried and transferred on the developer carrier can be suppressed. Thereby, the toner concentration of the developer in the developer carrier can be controlled within a preset range.

According to the above developing apparatus to control the toner concentration of the developer in the developer carrier within a preset range (self toner concentration control), because the toner concentration sensor is not required and the stirring device such as a paddle screw etc can be omitted, the toner supply device can be simplified. Furthermore, in comparison with the conventional two-component developing method, the magnetic carrier can be reduced and the torque of the developing apparatus can be significantly reduced. As a result, the device can become smaller and more compact, and the cost can be reduced. Moreover, because the toner in the toner container can be directly supplied to the developer in the developer carrier passing through the developing area, the toner can be quickly supplied to a portion of the developer where the toner concentration decreases. Therefore, the forming ability for the black solid image is excellent.

In comparison with the conventional two-component developing method, in the developing apparatus that performs the self toner concentration control by only a few magnetic carriers, because the initial developer has to be uniformly set in the developer carrier, an initial developer container is installed in the vicinity of the developer container, and at the beginning of use, the user strips off a sealing material that separates the initial developer container from the developer container, so that the initial developer is filled into the initial developer container. In addition, in order to prevent the toner from acuminating in the toner supply unit with a toner supply gate near the developer carrier and to prevent the toner from scattering out of the toner container, a sealing material is installed for separating the toner container from the toner supply unit. This sealing material will be also stripped off by the user at the beginning of use. After the sealing material is stripped off, the developing apparatus is set into the printer, and then the toner supply unit installed in the developer carrier and the toner container rotates via gears at the same time. Then, it begins to send the initial developer to the developer carrier or begins to supply the toner to the toner supply unit.

However, at the location to strip off the sealing materials, in order to maintain a working space for stripping off the sealing materials in the longitudinal direction of the developing apparatus, i.e., the central axis line of the developer carrier, it happens that the sealing materials are stripped off under a condition that the developing apparatus is tilt. When the sealing materials are stripped off under a condition that the developing apparatus is tilt, the initial developer in the initial developer container moves to one end along the central axis line of the developer carrier, which causes the initial developer to be not uniformly set on the developer carrier along the central axis line of the developer carrier. Therefore, the toner will be over supplied to the insufficient developer area having little developer, and therefore as the toner concentration increases, abnormal image due to contamination occurs. In contrast, the developer will be scattered in the developer area having much developer. In addition, in the developing apparatus, because no stirring mechanism is provided to cycle the developer along the central axis line of the developer carrier and to stir the developer, once the initial developer is not uniformly set, the non-uniform developer problem cannot be solved, so that the abnormal image due to contamination or the developer scatter continuously occurs.

SUMMARY OF THE INVENTION

According to the foregoing description, an object of this invention is to provide a developing apparatus, an image formation apparatus and a process cartridge, by which even though the sealing material is installed on the initial developer throwing opening of the initial developer container under a condition where the developing apparatus is tilt, the initial developer can be uniformly supplied along the central axis line of the developer carrier.

According to the object(s) mentioned above, the invention provides a developing apparatus, comprising a developer carrier, a developer regulating unit, a developer container, a toner container, an initial developer container, and a sealing material. The developer carrier has a magnetic field generating device therein, for carrying a developer containing a toner and a magnetic carrier and transferring the developer to move on a surface of the developer carrier. The developer regulating unit is used for regulating an amount of the developer that is carried on the developer carrier and transferred towards a developing area. The developer container is used for containing the developer that is regulated by the developer regulating unit and transferred towards a developing area. The toner container has a toner supply gate facing a surface of the developer carrier at a position adjacent to an upstream side of a developer transfer direction in the developer container. The initial developer container is used for containing a non-used initial developer that is thrown to the initial developer container. The sealing material is used for sealing an initial developing throwing opening installed on one side of the developer container of the initial developer container, and capable of being stripped off along a central axis line of the developer carrier. By moving the developer when the developer is transferred on the developer carrier, the toner in the toner container is taken into the developer according to a toner concentration of the developer on the developer carrier. Furthermore, a plurality of partitions is formed inside the initial developer container so that a plurality of partition spaces is divided along the central axis line of the developer carrier inside the initial developer container, and wherein based on the initial developer throwing opening, a partition surface facing to the partition space of each partition is tilted to one end of the central axis line of the developer carrier with respect to an imaginary plane perpendicular to the central axis line of the developer carrier.

According to the above developing apparatus, at the beginning of use, in the two ends of the central axis line of the developing apparatus, the tilt direction of the partition surface of each partition is set to one end located at lower side in the vertical direction when the developing apparatus is tilted for stripping off the developer sealing. As the developing apparatus is tilted, because the direction of stripping off the sealing material is tilted from the horizontal direction, the working space in the horizontal direction for stripping of the sealing material can be maintained in comparison with that the sealing material is stripped off in the horizontal direction.

Furthermore, when the developing apparatus is tilted towards the preset direction, the difference in vertical height between one end of the initial developer throwing opening of the partition surface faced under each partition space of the initial developer container and the opposite end is smaller than that in the conventional developing apparatus that the partition surface is not tilted but formed along the imaginary surface. Otherwise, the vertical height of the initial developer throwing opening of the partition surface is higher than its opposite end. Thereby, in comparison with the conventional developing apparatus, the initial developer in each partition space is hardly to move near the initial developer throwing opening, and therefore the initial developer can be easily maintained in the each partition space. Accordingly, even though the sealing material is stripped off under the condition that the developing apparatus is tilted in the preset direction, it can suppress the initial developer in each partition space from falling into the initial developer container due to gravity.

Therefore, after the sealing material is stripped off and when the developing apparatus returns to the non-tilt status in common use from the status that the developing apparatus is tilted in the preset direction, and because the initial developer existing in each partition space of the initial developer container can be slowly filled into the developer container installed along the surface of the developer carrier, the initial developer can be uniformly supplied along the central axis line of the developer carrier.

As described above, because there is no deviation in that the initial developer is uniformly supplied along the central axis line of the developer carrier, and the self toner concentration control is performed so that the toner concentration of the developer on the developer carrier can be well controlled within a certain range, it can prevent contamination because the toner will be over supplied to the insufficient developer area, or can prevent the developer from being scattered in the developer area having much developer.

The above developing apparatus further comprises a second developer regulating unit located between the toner supply gate of the toner container that faces the surface of the developer carrier, for regulating the amount of the developer on the developer carrier that is carried and transferred towards the developer container from the opposite side of the toner container. A gap can be set between the second developer regulating unit and the surface of the developer carrier, so that the regulated amount of the developer increases when the toner concentration of the developer on the developer carrier increases. In this situation, by using the second developer regulating unit, the toner concentration can be stably controlled without being affected by the magnetic unevenness on the developer carrier.

In addition, the above partition is formed with a plate shape, and each of the partitions is tilted with respect to an imaginary plane.

Accordingly, by tilting the partitions that are formed with a plate shape, the tilt of the partition surface can be easily set, and the occurrence of the dead space in the initial developer container due to forming the partitions can be minimized.

The initial developer container has a sidewall perpendicular to the partition surface of each partition, and openings are formed on the sidewall to expose side ends of the partitions, and after the initial developer is filled into each partition of the initial developer container, a sealing material is set to seal the openings formed on the sidewall of the initial developer container.

Accordingly, when forming the initial developer container using the mold, because the mold can be removed by sliding along the partition surface of each partition through the opening formed on the sidewall, it is not needed to prepare a mold with a particular structure to form the initial developer container having the tilted partitions therein. In addition, after the initial developer is filled into each partition space of the initial developer container, because the partition spaces are sealed by sealing the openings, which are formed on the sidewall of the initial developer container for removing the mold, with the sealing material, the initial developer can be prevented from leakage.

The sealing material can use for example a thermal welding sheet that is widely used in fields such as the developing apparatus. The welded sealing material covers the openings of the initial developer container, and by heating and welding the side ends of the partitions exposed to the openings and the surroundings of the openings, the openings are then sealed. In addition to the thermal welding, the sealing material can be installed by supersonic welding or vibrational welding, or can be adhered by using the double-side tape or the adhesive.

The invention further provides an image formation apparatus, comprising a latent image carrier, a latent image formation device, a developing apparatus, and a transcribing device. The latent image formation device is used for forming a latent image on the latent image carrier. The developing apparatus is used for developing the latent image on the latent image carrier to form a toner image, and can be the developing apparatus mentioned above and is capable of detaching or attaching to the image formation apparatus. The transcribing device is used for transcribing the toner image on the latent image carrier to a transcriber.

Accordingly, before assembling the developing apparatus to the image formation apparatus, by stripping off the sealing material in such a way that the process cartridge having the developing apparatus is tilted to the preset direction, the working space for stripping off the sealing material can be easily maintained. Furthermore, the initial developer in the initial developer container can be uniformly supplied along the central axis line direction of the developer carrier. By installing the developing apparatus such that the initial developer is uniformly supplied to the image formation apparatus, the contamination or developer scattering can be prevented.

The invention also provides a process cartridge, comprising: a latent image carrier and a developing apparatus. The developing apparatus is used for developing the latent image on the latent image carrier to form a toner image. The developing apparatus is the developing apparatus mentioned above and is capable of detaching or attaching to the image formation apparatus. The process cartridge is integrally formed and detachable from the image formation apparatus.

In the above process cartridge, before assembling the developing apparatus to the image formation apparatus, by stripping off the sealing material in such a way that the process cartridge having the developing apparatus is tilted to the preset direction, the working space for stripping off the sealing material can be easily maintained. Furthermore, the initial developer in the initial developer container can be uniformly supplied along the central axis line direction of the developer carrier. By installing the process cartridge so that the initial developer is uniformly supplied to the image formation apparatus, the contamination or developer scattering can be prevented.

In addition to the latent image carrier and the developing apparatus, the process cartridge further includes at least one of a charging device for charging the latent image carrier or a cleaning device for cleaning the latent image carrier.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIGS. 8A and 8B show perspective views of a conventional initial developer case from two opposite directions;

FIG. 9 shows a cross-sectional view of the conventional initial developer case in FIGS. 8A and 8B;

DESCRIPTION OF THE PREFERRED EMBODIMENT

Figure 2:
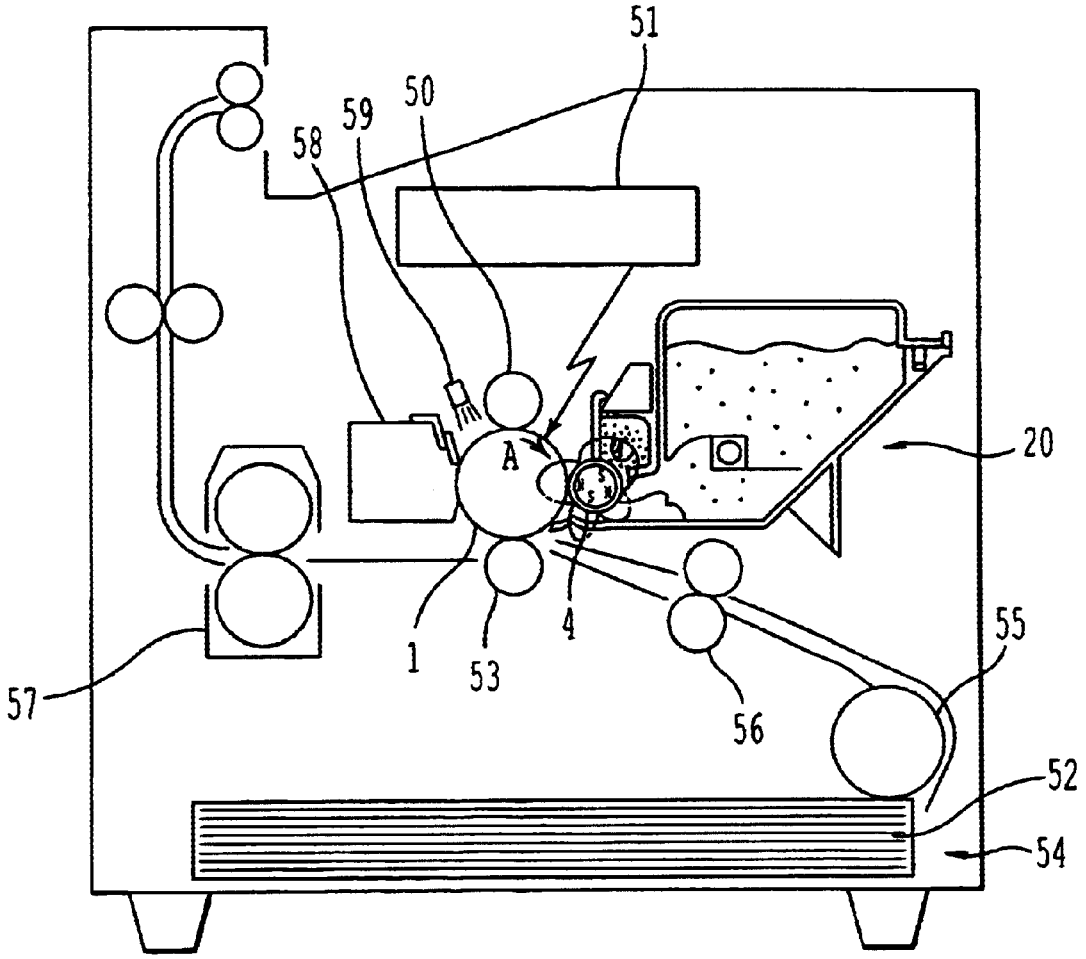
FIG. 2 is a schematic cross-sectional view showing a printer according to one embodiment of the invention.

The invention describes an embodiment suitable for a developing apparatus for an electronic photographic image formation apparatus, such as a laser printer (printer, hereinafter). FIG. 2 is used to describe in summary a printer according to this embodiment. The photo-sensing drum 1, used as a latent image carrier, is driven to rotate in a direction of arrow A in the drawing. Then, the photo-sensing drum 1 is charged by using a charging roller 50 in contact with its surface and therefore charging the surface. Afterwards, the photo-sensing drum 1 is exposed in a scanning manner by an optical writing unit 51 based on image information to form an electrostatic latent image on the surface of the photo-sensing drum 1. In the embodiment, the latent image forming device is constituted of the charging roller 50 and the optical writing unit 51, but other charging devices and exposure devices can also be used. The electrostatic latent image formed on the photo-sensing drum 1 is developed by a developing apparatus 20 (will be described later) to form a toner image on the photo-sensing drum 1. By a transcribing unit having a transcribing roller 53, the toner image formed on the photo-sensing drum 1 is transferred from the paper-feeding cassette 54, via the paper-feeding roller 55 and the register roller pair 56, and then transcribed on a paper 52 used as a transcriber. After the paper 52 is transcribed, the toner image is fixed by a fixing unit 57, and then the paper 52 is ejected out of the machine. In addition, the remaining toner on the photo-sensing drum 1 that is not transcribed is removed from the photo-sensing drum 1 by a cleaning unit 58. The remaining charge on the photo-sensing drum 1 is removed by a de-charging lamp 59.

In addition, the printer of the invention is constituted by a process cartridge having at least one photo-sensing drum 1 and a developing device 20, and the process cartridge can be detached from or attached to the printer. By removing the process cartridge from the printer, the photo-sensing drum 1 or the developing device 20 can be replaced. In addition to the photo-sensing drum 1 and the developing device 20, at least one of the charging roller 50 or the cleaning unit 58 etc can be also included in the process cartridge.

Figure 3:
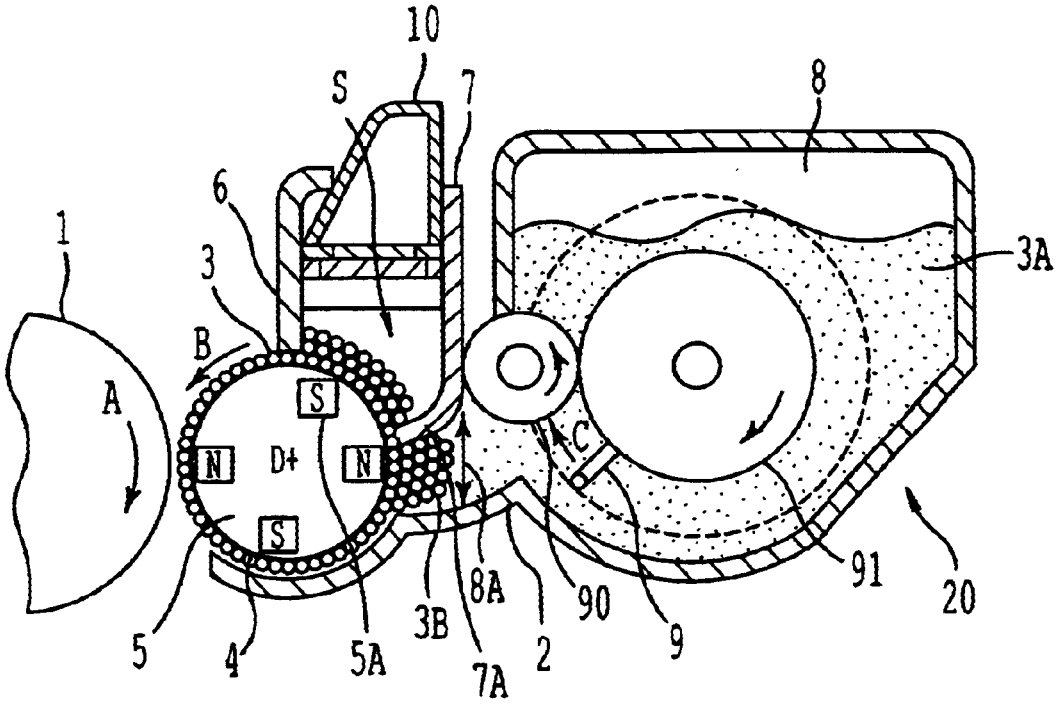
FIG. 3 schematically shows the entire structure of the developing device 20

Next, the following description is the entire structure of the developing device according to the invention. FIG. 3 schematically shows the entire structure of the developing device 20. The developing device 20 is arranged near one side of the photo-sensing drum 1. In a casing 2 that has an opening toward the photo-sensing drum 1, the developing device 20 comprises a developing sleeve 4, a magnet roller 5, a doctor knife 6, a developer containing case 7, a toner bottle 8, and an initial developer case 10. The developing sleeve 4 is made of the non-magnetic material to serve as a developer carrier for carrying the developer 3 on its surface, wherein the developer 3 is composed of toner and magnetic carrier, and a portion of which is exposed to the opening. The magnet roller 5 is fixed and arranged in the developing sleeve 4 to serve as a magnetic field generating device. The doctor knife 6 is a developer regulating device for regulating the amount of the developer that is carried and transferred on the developing sleeve 4. The toner bottle 8 is used for receiving the toner. The initial developer case 10 is used for containing the non-used initial developer. The symbol D in the drawing represents a central line of the developing sleeve 4, extending in the direction perpendicular to the paper.

A developer containing space S is formed between the developer containing case 7 and the developing sleeve 4 for containing the developer that is not supplied to a developing area opposite to the photo-sensing drum 1 and is stopped by the doctor knife 6. As will be described later, in the magnet roller 5 that is fixed and arranged in the developing sleeve 4, magnetic poles 5*a*, for letting the developing sleeve 4 carry the developer 3 in the developer containing space S, are arranged opposite to the developer containing space S. In addition, a pre-doctor knife 7*a* is arranged at the front end (the visor portion) of the developer containing case 7 near the developing sleeve 4 as a second developer regulating device, and is used for regulating the amount of the developer 3 that is moved from the toner bottle 8 towards the developer containing space S where the toner is supplier to.

Figure 4:
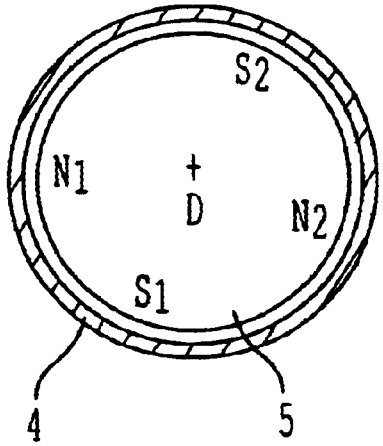
FIG. 4 is an enlarged diagram of a magnet roller and a developing sleeve in the developing apparatus.

As shown in FIG. 4, a plurality of magnetic poles, extending along the direction of the central line of the magnet roller 5, are formed on the surface of the magnet roller 5. For example, a principle pole (N pole: N1) is formed at a position opposite to the developing area, and a magnetic pole (S pole: S1) is arranged between a position opposite to the pre-doctor knife 7*a* and the developing area, so that the magnetic force created by the magnetic field can reach the developer containing space S. In addition, similar to the general image formation apparatus, transfer magnetic poles (S pole: S1, N pole: N2), which are used for keeping the developer to be carried on the developing sleeve 4 and therefore to transfer, are properly arranged on the surface of the magnet roller 5. Furthermore, the embodiment uses a fixed magnet that is a magnet plate fixedly fitted to a base, i.e., a block-type magnet roller, but this is not used to limit the invention. For example, a plastic magnet material that is formed with a preset shape is magnetically aligned and magnetized at the same time, i.e., a ferrite built-in type plastic magnet roller can be also used.

The toner bottle 8 has a toner supply gate 8*a* that is opposite to the surface of the developing sleeve 4 and adjacent to the upstream side of the developer containing space S in the developer transfer direction. A toner supply agitator 9 as a toner supply unit is arranged in a space (toner supply path) near the toner supply gate 8*a* for stirring the new toner in the toner bottle 8 toward the toner supply gate 8*a* and sending the stirred toner out of the toner bottle 8. As shown by the dashed line, the position of the rotational shaft and the length of the fin are adjusted, and therefore the toner supply agitator 9 is set so that the outermost trajectory of the toner supply agitator 9 does not shake the developer. In addition, the toner supply agitator 9 is driven to rotate by gears 90, 91 that are used as driving unit.

Figure 5:
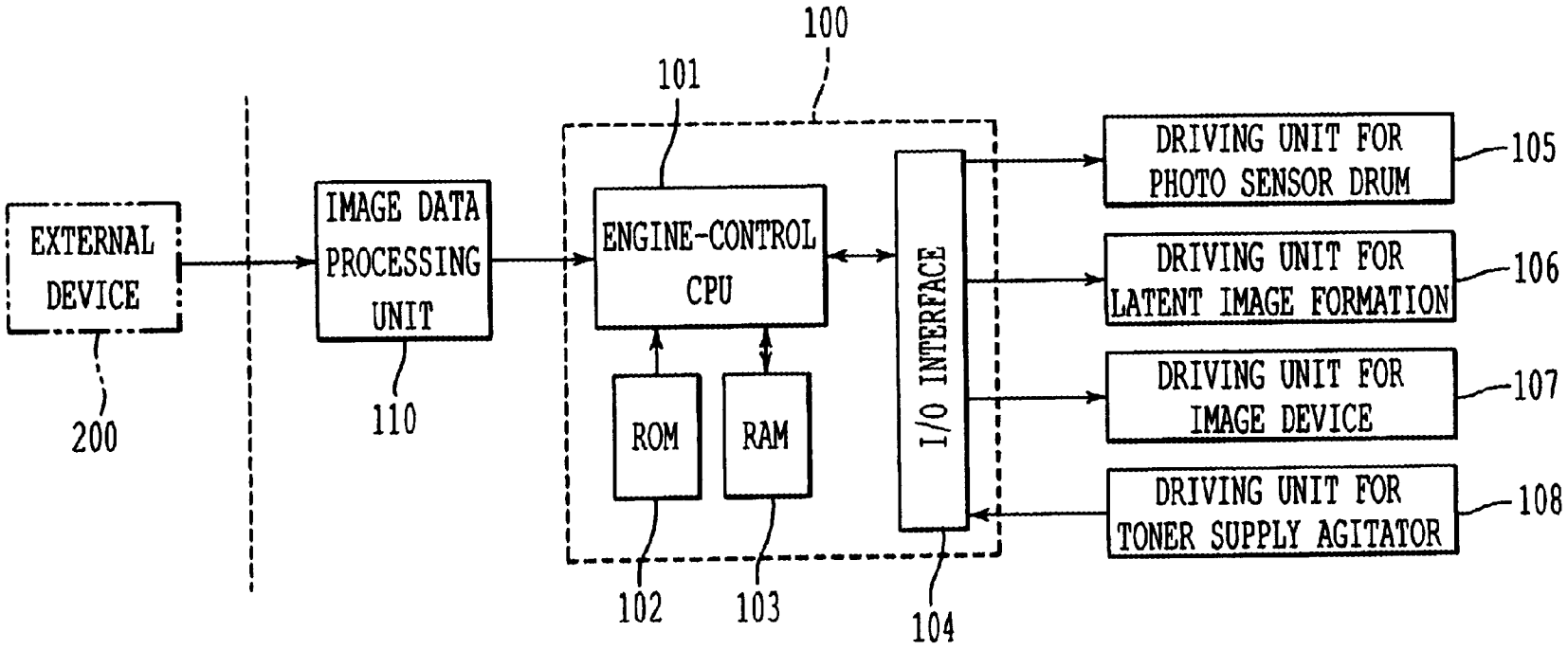
FIG. 5 is a block diagram showing an exemplary controlling unit for controlling the printer of the invention

FIG. 5 is a block diagram showing an exemplary controlling unit for controlling the printer of the invention. Image data, transmitted from an external device such as a personal computer, is processed by an image data processing unit 110. The engine controlling unit 100 is used for controlling each unit in the apparatus according to the data transmitted from the image data processing unit 110, and comprises an engine controlling CPU 101, a ROM 102, a RAM 103 and an I/O interface 104 etc. The engine controlling unit 100 is coupled to a photo-sensing drum driving unit 105, a driving unit 106 for a latent image formation, a driving unit 107 for the developing apparatus 2, and a driving unit 108 for the toner supply agitator 9, etc. The engine controlling CPU 101 executes various identifications and determinations, outputs operation commands to each unit, and performs predetermined operations according to controlling program(s) read from the ROM 102 in response to input signal(s) from the image data processing unit 110.

In the above configuration FIG. 3 of the developing apparatus 20, the developer 3 carried on the developing sleeve 4 is transferred to the sleeve near the doctor knife 6 along the direction B, following the rotation of the rotating developing sleeve 4. The thinned developer 3 is transferred toward the developing area opposite to the photo-sensing drum 1 that rotates along the direction A. The toner is supplied to the electrostatic latent image formed on the photo-sensing drum 1 in a contact or a non-contact way at the developing area, and therefore the electrostatic latent image is visualized. The developer 3 on the developing sleeve 4 that passes the developing area is further transferred by the rotation of the developing sleeve 4, and then reaches a position opposite to the toner supply gate 8*a*. The developer stays at the toner supply gate 8*a* so that the toner 3*a* in the toner bottle 8 is in contact with the developer 3 on the developing sleeve sent out by the toner supply agitator 9. After new toner is taken at the toner supply gate 8*a*, the developer 3 returns to the developer containing space S. The developer 3 containing the new toner 3*a* increases the internal pressure due to the doctor knife 6. The toner is charged due to the triboelectricity with a carrier in the developer whose internal pressure has increased. As described, because the toner in the developer 3 on the developing sleeve 4 can be charged by the internal pressure of the developer 3 in the developer containing space S, any complicated stirring and transferring mechanism using the paddle or the screw etc for charging or stirring the developer 3 is not required.

On the other hand, a portion of the developer 3, which is stopped by the doctor knife 6 without being supplied to the developing area, moves toward the toner supply gate 8*a* of the toner bottle 8 because of the internal pressure and the gravity of the developer 3 in the developer containing space S. The developer 3 moving to the vicinity of the toner supply gate 8*a* is further regulated by the pre-doctor knife 7*a* and the developer 3 is pulled near the developing sleeve 4 by the magnetic force of the magnetic pole 5*a*. The pre-doctor knife 7*a* is a second developer regulating unit and arranged at an upstream side of the developing sleeve rotational direction with respect to the doctor knife 6. Furthermore, as the developing sleeve 4 rotates, the developer 3 is cycled in the developer containing space S by transferring toward the doctor knife 6.

In the structure of the above developing apparatus 20, as the toner supplied to the developer 3 increases and the toner concentration increases, the volume of the developer increases also, so that the developer 3 moves towards the pre-doctor knife 7*a*. The developer 3 not regulated by the pre-doctor knife 7*a* forms a developer stationary portion 3*b* and then covers the toner supply gate 8*a*. Therefore, the amount of the toner supplied to the developer on the developing sleeve 4 reduces. Due to the reduction of the toner supply amount, the toner concentration in developer 3 can be maintained below a predetermined concentration. In contrast, as the toner concentration in the developer 3 decreases, the volume of the developer 3 reduces so that the developer stationary portion 3*b* does not block the toner supply gate 8*a*, so that the toner can be supplied to the developer 3 on the developing sleeve 4 up to the predetermined amount. Therefore, the toner concentration in developer 3 can be maintained above the predetermined concentration.

In the situation for making the toner concentration change, by varying the amount of the magnetic carrier contained in the developer containing space S, the volume change of the developer can be controlled. For example, because the volume of the developer reduces as the magnetic carrier is reduced by a certain amount, the amount of the toner fed from the toner supply gate 8*a* increases so that the toner concentration in the developer 3 can be increased. As described, because the toner concentration can be controlled within a range, a complicated toner concentration controlling mechanism using the toner concentration sensor or the toner supply unit etc is not required.

Figure 6:
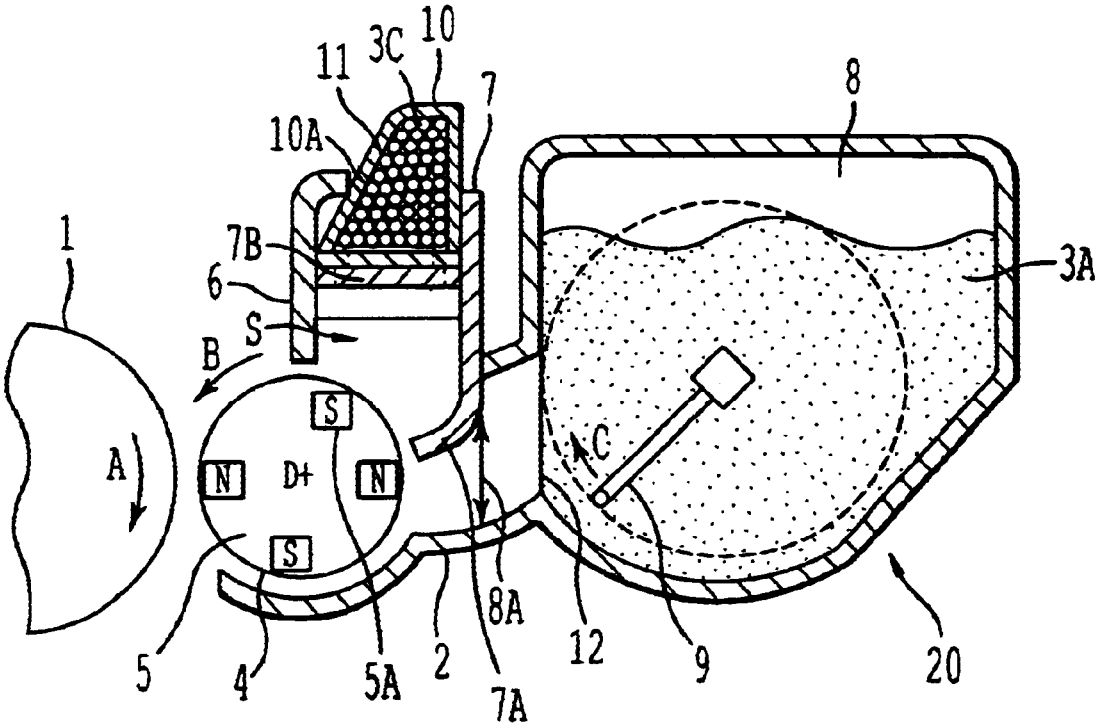
FIG. 6 is a schematic diagram of the developing apparatus before use.

Next, follows a description of a method for inputting non-used initial developer at the beginning of use of the developing apparatus, the structure of the initial developer case 10 and a method for making the case according to the present invention. FIG. 6 is a schematic diagram of the developing apparatus 20 before use. The initial developer case 10 containing the non-used initial developer 3*c* is loaded above the developer containing space S of the developing apparatus 20. The initial developer 3*c* in the initial developer case 10 can be input into the developer containing space S through an opening 10*a* for inputting the initial developer and a developer receiving opening 7*b*. The opening 10*a* is formed beneath the initial developer case 10, and the developer receiving opening 7*b* is formed on the developer container case 7 that forms the developer containing space S.

A developer sealing material 11 is assembled in the initial developer case 10 for sealing the opening 10*a* from the inside. By the developer sealing material 11, the developer containing space S can be separated from the inside of the initial developer case 10 during transportation before use, so that the initial developer 3*c* in the initial developer case 10 will not leak to the developer containing space S. The developer sealing material 11 is assembled so that the user can strip developer sealing material 11 along the direction of the central axial line D of the developing sleeve 4, i.e., the direction perpendicular to the drawing of FIG. 6.

There is a connection opening in the toner bottle 8 for connecting the space (toner supply path) adjacent to the toner supply gate 8*a*, and a toner sealing material 12 is installed for sealing the connection opening. By the toner sealing material 12, the tone supply gate 8*a* can be separated from the inside of the toner bottle 8 during transportation before use, so as to prevent the toner from accumulating in the space (toner supply path) adjacent to the toner supply gate 8*a*, or to prevent the toner from scattering out of the toner bottle 8.

When the initial developer 3*c* is sent to the developing apparatus 20 having the above structure and the developing apparatus 20 begins to be used, because the initial developer 3*c* has to be uniformly set on the developing sleeve 4, the developer sealing material 11 assembled in the initial developer case 10 is stripped and the initial developer 3*c* is then sent into the developer containing space S. In addition, the toner sealing material 12 for separating the space (toner supply path) adjacent to the toner supply gate 8*a* from the inside of the toner bottle 8 is also stripped when the user begins to use the developing apparatus 20. As described above, when the user begins to use the developing apparatus 20, the process cartridge including the developing apparatus 20 is set in the printer, and the developing sleeve 4 and the toner supply agitator 9 installed in the toner bottle 8 are driven to rotate at the same time through gears. Thereafter, the initial developer 3*c* is sent to the developing sleeve 4 and the toner supply begins.

In the conventional developing apparatus, because the initial developer 3*c* set onto the developing sleeve 4 or the toner supply are performed at the same time, when stripping off the sealing materials 11, 12 and the process cartridge including the developing apparatus is tilted, the initial developer 3*c* in the developer containing space S moves along the longitudinal direction of the developing sleeve 4 (the central axis direction), by which the initial developer 3*c* is not uniformly set on the developing sleeve 4 in the longitudinal direction. Accordingly, the toner is over supplied to a portion having only a little developer, and therefore the toner concentration increases, thereby the abnormal image due to the contamination occurs. In contrast, the developer scatters in a portion having too much developer.

Figure 1:
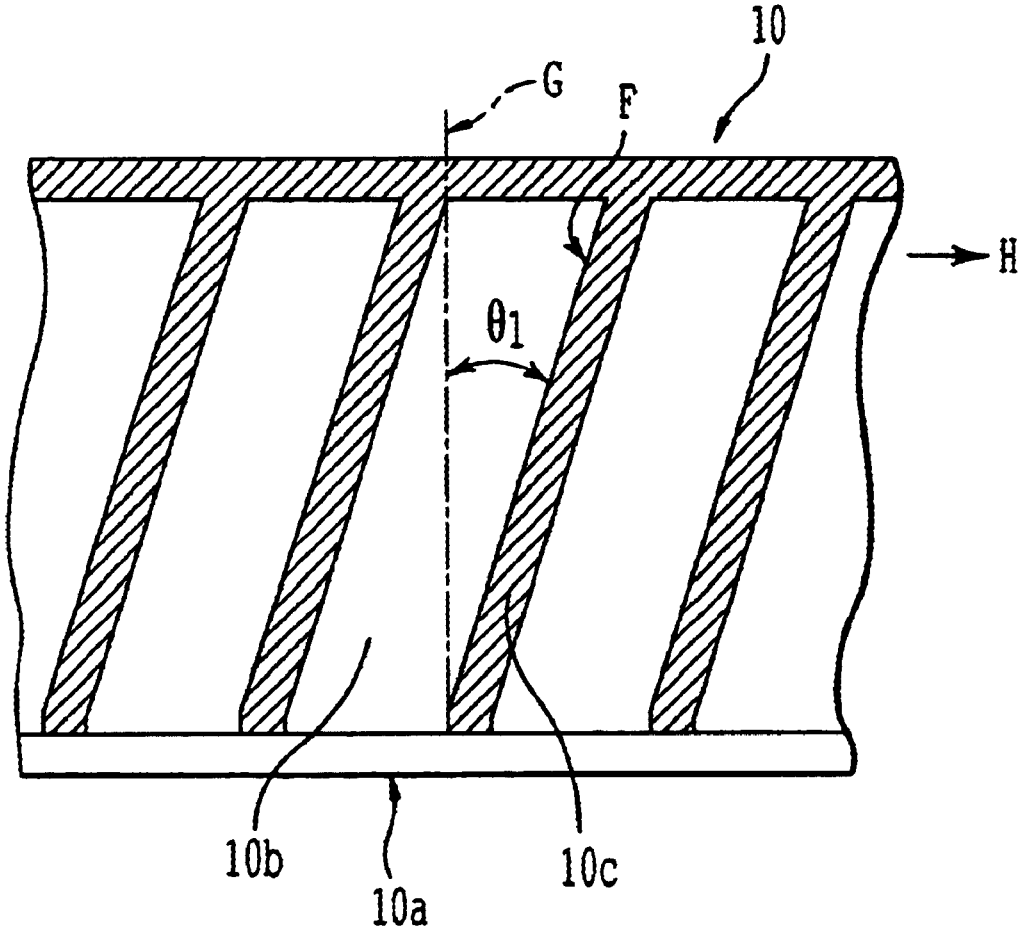
FIG. 1 is a schematic cross-sectional view showing an internal structure of an initial developer case according to one embodiment of the invention.

In the present embodiment, as shown in FIG. 1 and FIG. 3, the initial developer case 10 is divided internally into a plurality of partition spaces 10*b* along the direction of the central axial line D of the developing sleeve 4, so that a plurality of partitions 10*c* is formed inside the initial developer case 10. Based on the opening 10*a* for inputting the initial developer, the partition surface F facing to the partition space 10*b* between each partition 10*c* is tilted from an imaginary plane G perpendicular to the central axial line D of the developing sleeve 4 toward one end H along the direction of of the central axial line D of the developing sleeve 4 (right side in the drawing).

Preferably, the tilt angle $\theta_1$ of the partition surface F of each partition 10*c* with respect to the imaginary plane G is 20°~45°. In addition, the tilt angle $\theta_1$ of the partition surface F is preferably set so that the initial developer 3*c* can be firmly maintained by the partition spaces 10*b* when raising one end of the process cartridge in order to strip off the developer sealing. Namely, the tilt angle $\theta_1$ is set so that the end near the opening 10*a* of the partition 10*c* is higher, and the opposite end is lower. Additionally, in the two ends of the longitudinal direction of the developing apparatus 20, the tilt direction of the partition surface F of each partition is set to one end located at lower side in the vertical direction when the developing apparatus is tilted for stripping off the developer sealing.

Figure 7:
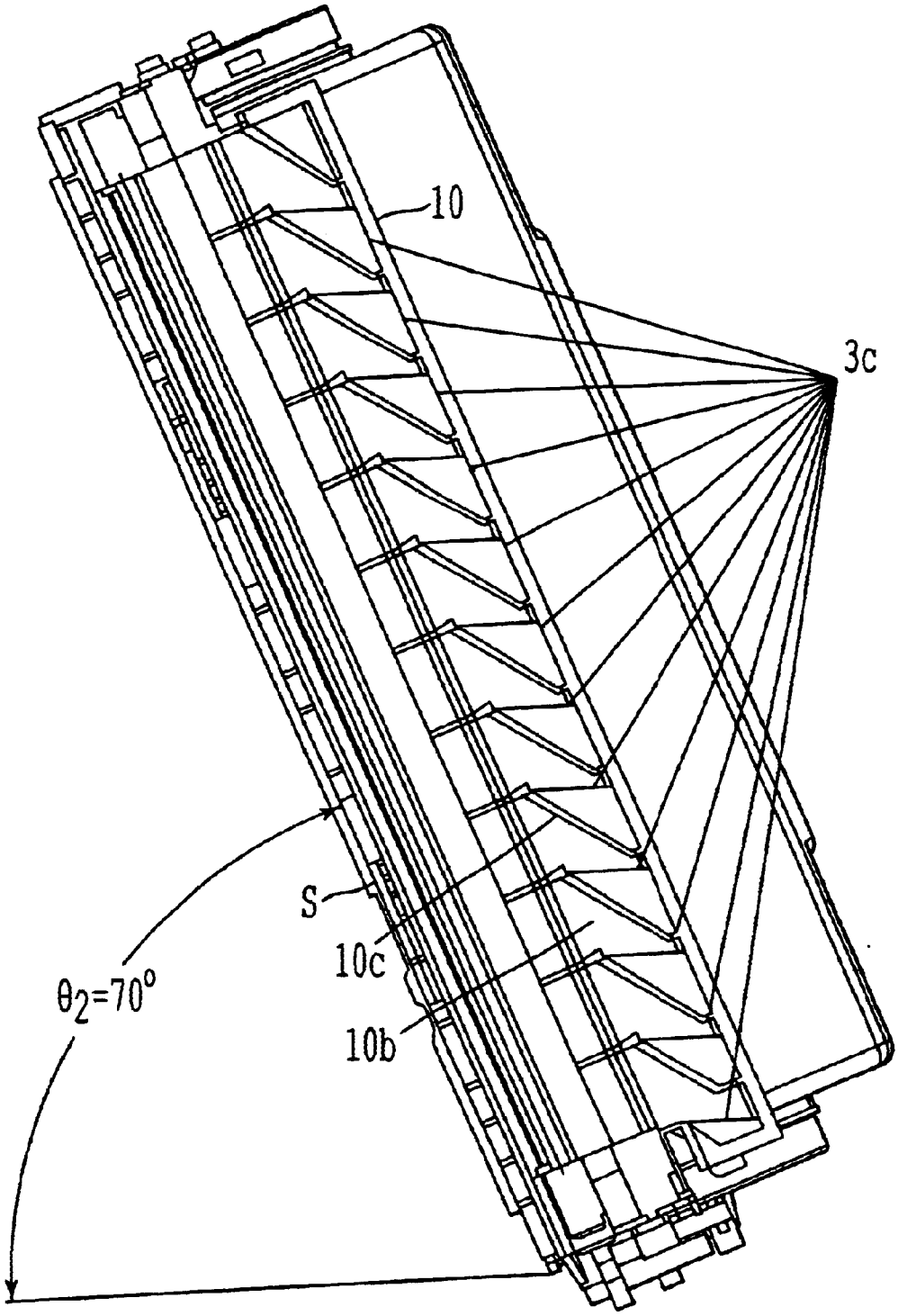
FIG. 7 is a perspective view showing the internal structure of the initial developer case 10 when tilting the developing apparatus with the initial developer case 10 having partitions 10*c* formed therein under a condition that the developer sealing material 11 is not stripped.

FIG. 7 is a perspective view showing the internal structure of the initial developer case 10 when tilting the developing apparatus with the initial developer case 10 having partitions 10*c* formed therein under a condition that the developer sealing material 11 is not stripped. In FIG. 7, the aforementioned end in the longitudinal direction of the developing apparatus 20 is set as a down side, and then the developing apparatus 20 is tilted only by $\theta_2$=70° from the horizontal line. Under the tilt condition of the developing apparatus 20, even though the developer sealing material 11 for sealing the openings 10*a* is stripped off, the initial developer 3*c* can be maintained within each partition space 10*b* of the initial developer case 10. Therefore, the developer can be controlled to fill into the developer containing space S and then be moved to one end of the developing sleeve 4 in the longitudinal direction. Thereafter, as the developing apparatus 20 after the developer sealing material 11 has been stripped returns to the horizontal status, the initial developer 3*c* in the partition spaces 10*b* can be directly sent to the underneath developing sleeve 4.

According to the invention, even if the developer sealing material 11 is stripped under a condition that the process cartridge having the developing apparatus is tilted, the initial developer 3*c* can be prevented from accumulating at one side in the central axial line D of the developing sleeve. Therefore, it can prevent a portion of the toner from being over supplied, prevent the toner concentration from being suddenly increased, prevent contamination from occurrence, and prevent the developer from being scattered.

In conventional developing, the partition surface of the partition in the initial developer case 10 is perpendicular to the central axial line D of the developing sleeve. When pulling the developing sealing material 11 out, even though $\theta_2$ tilts up to 45°, no abnormal image occurs. However, if $\theta_2$ tilts over that angle, the developer is scattered and contamination occurs. Regarding this issue, in the developing apparatus of the invention, even if $\theta_2$ is tilted up to 90° to pull out the developer sealing material 11, it can be confirmed that the developer is not scattered and contamination does not occur.

Referring to FIGS. 8A and 8B, for pursuing lightness and less expense, the initial developer case 10' is formed by resin. As shown in FIG. 9, the parting line PL of the initial developer case 10' used in the conventional developing apparatus is perpendicular from the cross-sectional view of the side of the case 10'. Because the partition 10*c*' in the initial developer case 10' is automatically perpendicular to the parting line PL, there is no problem in the structure of the mold.

However, because the partition 10*c* in the initial developer case 10 of the invention is tilted, and therefore from the side view of the initial developer case 10, if the parting line PL is set to be perpendicular as in the conventional manner, the initial developer case 10 has to be arranged to tilt the mold in order to make the partition 10*c* perpendicular to the parting line PL, but it is difficult to implement in practice.

Figure 10A:
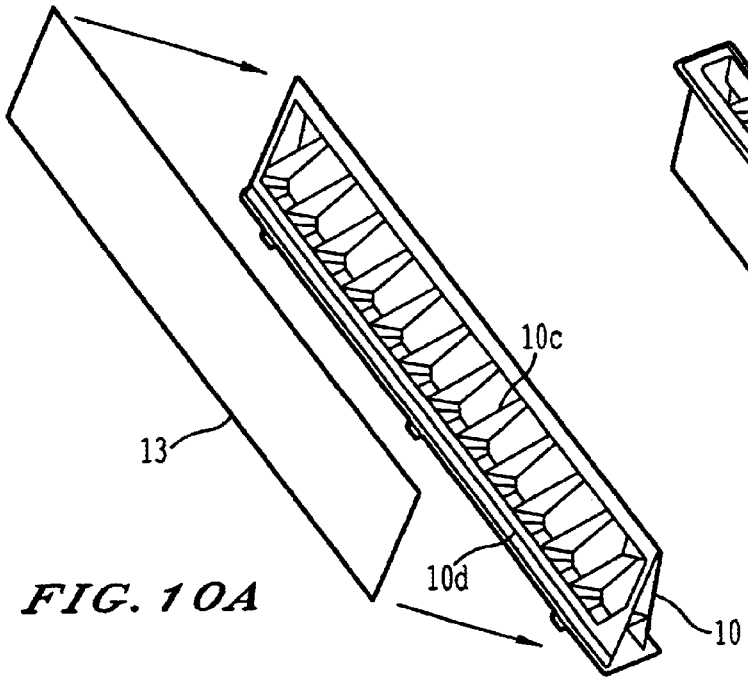
FIGS. 10A and 10B show perspective views of the initial developer case of the embodiment.
Figure 10B:
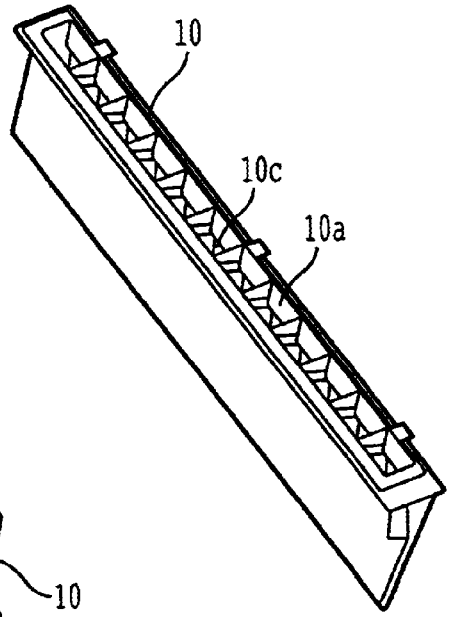
Figure 11:
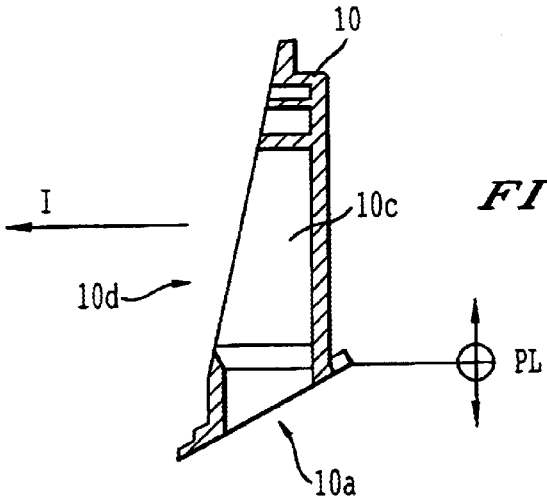
FIG. 11 shows a cross-sectional view of the initial developer case of the embodiment.

FIGS. 10A and 10B show perspective views of an initial developer case of the embodiment, and FIG. 11 shows a cross-sectional view of the initial developer case of the embodiment. As shown in the embodiment, openings 10*d* are formed on sidewalls that are perpendicular to the partition surfaces F, FIG. 1, of the partitions 10*c* of the initial developer case 10, so as to expose the side ends of the partitions 10*c*. After the initial developer is filled into each partition space 10*b* of the initial developer case 10, a sealing plate 13 is set to seal the openings 10*d* formed on the sidewall of the initial developer case 10. By forming the openings 10*d*, when molding the initial developer case 10, the parts (of the initial developer case 10) are taken out by sliding the mold along the direction I showing in FIG. 11, so that no particular mold structure is required and the initial developer case 10 can be easily made.

In addition, the openings 10*d* that are opened on the sidewall of the initial developer case 10 are sealed by the sealing plate 13 after being filled with the initial developer 3*c*. The sealing plate 13 can use a thermal welding sheet that can also be used as the other sealing materials 11, 12. Furthermore, in addition to installing the sealing plate 13 by thermal welding to seal the openings 10*d*, other materials can be installed by supersonic welding or vibrational welding, or double-side tape or adhesive can be used to adhere the sealing plate.

According to the embodiment, the process cartridge, having the photo-sensing drum 1 and the developing apparatus 20, is capable of attaching to or detaching from the printer. However, the invention is also suitable in that the developing apparatus 20 alone is also capable of attaching or detaching to the printer, and the same effects and advantages can be achieved.

The foregoing embodiment describes that the developing apparatus has a pre-doctor knife as a second developer regulating unit that is assembled opposite to the surface of the developing sleeve with a predetermined gap. However, the invention can be applied where no pre-doctor knife is assembled, but the same effects and advantages can be achieved.

In addition, the embodiment describes the laser printer and the developing apparatus used in the laser printer. However, the invention can be also suitable for other image formation apparatus such as the copy machine or the FAX machine etc, and the developing apparatus used in the image formation apparatus.

According to the invention, in order to maintain the working space for stripping off the sealing material installed on the initial developer throwing opening of the initial developer container, even though the sealing material is stripped off when the developing apparatus is tilted, the initial developer can be maintained in each partition space in the initial developer container. When the developing apparatus returns to the non-tilt status in common use, the initial developer existing in each partition space of the initial developer container can be slowly filled into the developer container, so that the initial developer can be uniformly supplied along the central axis line of the developer carrier.

According to the invention, the tilt of the partition surface can be easily set, and by forming the partition, the occurrence of the dead space in the initial developer case can be minimized.

Furthermore, the initial developer case having tilt partition therein can be formed without preparing a mold with a particular structure. In addition, it can prevent the initial developer from leakage.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A developing apparatus, comprising:

a developer carrier, having a magnetic field generating device therein, for carrying a developer containing a toner and a magnetic carrier and transferring the developer to move on a surface of the developer carrier;

a developer regulating unit, for regulating an amount of the developer that is carried on the developer carrier and transferred towards a developing area;

a developer container, for containing the developer that is regulated by the developer regulating unit and transferred towards a developing area;

a toner container, having a toner supply gate facing a surface of the developer carrier at a position adjacent to an upstream side of a developer transfer direction in the developer container;

an initial developer case, for containing a non-used initial developer that is transferred to the developer container;

a sealing material, for sealing an initial developer input opening installed on one side of the initial developer case, and capable of being stripped off along a central axis line of the developer carrier;

wherein by moving the developer when the developer is transferred on the developer carrier, the toner in the toner container is taken into the developer according to a toner concentration of the developer on the developer carrier;

wherein at least the initial developer case is removable from an image forming device that the developing apparatus is installed in; and wherein a plurality of partitions are formed inside the initial developer case so that a plurality of partition spaces are divided along the central axis line of the developer carrier inside the initial developer case, and wherein based on the initial developer input opening, a partition surface facing to the partition space of each partition is tilted to one end of the central axis line of the developer carrier with respect to an imaginary plane perpendicular to the central axis line of the developer carrier such that movement of the initial developer is reduced when the initial developer case is tilted to strip off the sealing material.

2. The apparatus of claim 1, wherein the partitions are formed with a plate shape, and each of the partitions is tilted with respect to said initial developer input opening.

3. The apparatus of claim 2, wherein the initial developer case has a side wall perpendicular to the partition surface of each partition, and openings are formed on the side wall to expose side ends of the partitions, and after the initial developer is filled into each partition of the initial developer case, a sealing material is set to seal the openings formed on the side wall of the initial developer case.

4. An image formation apparatus, comprising:

a latent image carrier;

a latent image formation device, for forming a latent image on the latent image carrier;

a developing apparatus, for developing the latent image on the latent image carrier to form a toner image, wherein the developing apparatus comprises a developing apparatus according to any one of claims 1–3, and capable of detaching or attaching to the image formation apparatus; and a transcribing device, for transcribing the toner image on the latent image carrier to a transcriber.

5. A process cartridge, comprising:

a latent image carrier;

a developing apparatus, for developing the latent image on the latent image carrier to form a toner image, the developing apparatus comprising a developing apparatus according to any one of claims 1–3, and capable of detaching or attaching to the image formation apparatus; and wherein the process cartridge is integrally formed and detachable from an image formation apparatus.

* * * * *